US006939068B2

(12) United States Patent
Rawlings et al.

(10) Patent No.: US 6,939,068 B2
(45) Date of Patent: Sep. 6, 2005

(54) RETROFIT PRINTER TRAY RISER

(75) Inventors: Timothy W. Rawlings, Waynesville, OH (US); Timothy B. Baker, Miamisburg, OH (US); John C. Rosenbaum, Springboro, OH (US)

(73) Assignee: NCR Corporation, Dayton, OH (US)

( * ) Notice: Subject to any disclaimer, the term of this patent is extended or adjusted under 35 U.S.C. 154(b) by 47 days.

(21) Appl. No.: 10/349,413

(22) Filed: Jan. 22, 2003

(65) Prior Publication Data

US 2004/0141793 A1 Jul. 22, 2004

(51) Int. Cl.[7] ..... B41J 11/62; B41J 29/00; B41J 29/12

(52) U.S. Cl. ..... 400/718; 400/624; 271/162

(58) Field of Search ..... 271/146–171; 400/624, 627, 578, 691, 718

(56) References Cited

U.S. PATENT DOCUMENTS 4,714,243 A * 12/1987 Staniszewski ..... 271/171
4,969,048 A * 11/1990 Hoshino ..... 358/296
5,364,195 A * 11/1994 Kanemitsu et al. ..... 347/4
6,322,067 B1 * 11/2001 Fujii et al. ..... 271/145
6,332,067 B1 * 12/2001 Domoto ..... 399/307
6,406,201 B1 * 6/2002 Beretta et al. ..... 400/605
6,474,884 B2 * 11/2002 Chiu ..... 400/624
6,634,818 B2 * 10/2003 Sato et al. ..... 400/624

* cited by examiner

*Primary Examiner*—Andrew H. Hirshfeld
*Assistant Examiner*—Marissa Ferguson
(74) *Attorney, Agent, or Firm*—Francis L. Conte, Esq.

(57) ABSTRACT

A tray riser is configured for retrofit in a printer feed tray. The riser includes a plate for supporting a stack of sheets in the tray. A stand is integrally formed with a bottom of the plate to position a front edge of the plate higher in elevation than a back edge of the plate. A retention tab is integrally formed with the plate for engaging a pre-existing feature in the tray to retain the riser in the tray.

20 Claims, 5 Drawing Sheets

RETROFIT PRINTER TRAY RISER

BACKGROUND OF THE INVENTION

The present invention relates generally to printers, and, more specifically, to paper feeding therein.

Laser printers are manufactured in different models by different manufacturers and offer different performance. Printing paper may be stored in the printer in various forms of trays.

One form of tray is a drawer which slides horizontally into and out of a corresponding compartment in the printer. The drawer tray has a central well or receptacle in which a stack of printing paper of various composition may be held.

The drawer is closed during operation, and pickup rollers are moved into position atop the stack of paper for initially driving individual sheets into the feedpath of the printer. As the individual sheets leave the tray, one or more drive rollers begin the sheet transport through the printer for printing any desired information thereon and ejecting the printed sheet in an output tray for recovery.

A printer may include one or more stacked drawer trays with or without duplexing capability for feeding the sheets through the printer for printing one or both sides thereof as desired. The trays may have different configurations and capacity for holding the sheets, and have pickup and drive rollers specifically configured therefor.

Besides plain paper sheets for use in the printers, laminated form sheets may also be transported therethrough for printing. A laminated sheet typically includes a base sheet laminated to a liner by pressure sensitive adhesive and silicone release agent therebetween in a typical example. The liner may extend for the full configuration of the base sheet, or may cover only a small portion thereof depending upon the nature of the particular sheet.

For example, a pharmacy script form includes a single ply form sheet integrated with an extension thereof in a two-ply laminate with a release liner. The base sheet above the liner is die cut to define one or more removable labels initially bonded by the pressure sensitive adhesive to the liner. Both the form sheet and the individual labels can be printed in one pass through the printer for improving the typical pharmaceutical transaction.

The problem of undesirable curling during transport in the printer has been discovered in the use of various types of sheets in a specific commercially available laser printer, but not in other commercially available laser printers. In this printer, one corner of the form sheet can experience excessive curling during initial feeding of the sheet from the paper tray, with the corner being bent over backwards in dog-ear fashion upon engaging the first drive roller in the feedpath. This sheet curling can lead to sheet skewing through the printer feedpath, and even jamming therein. And, this curling problem can occur for various types of sheets of various composition.

Accordingly, it is desired to provide a remedy for undesirable sheet curling in a pre-existing commercially available printer without requiring changes thereof by the original equipment manufacturer.

BRIEF SUMMARY OF THE INVENTION

A tray riser is configured for retrofit in a printer feed tray. The riser includes a plate for supporting a stack of sheets in the tray. A stand is integrally formed with a bottom of the plate to position a front edge of the plate higher in elevation than a back edge of the plate. A retention tab is integrally formed with the plate for engaging a pre-existing feature in the tray to retain the riser in the tray.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
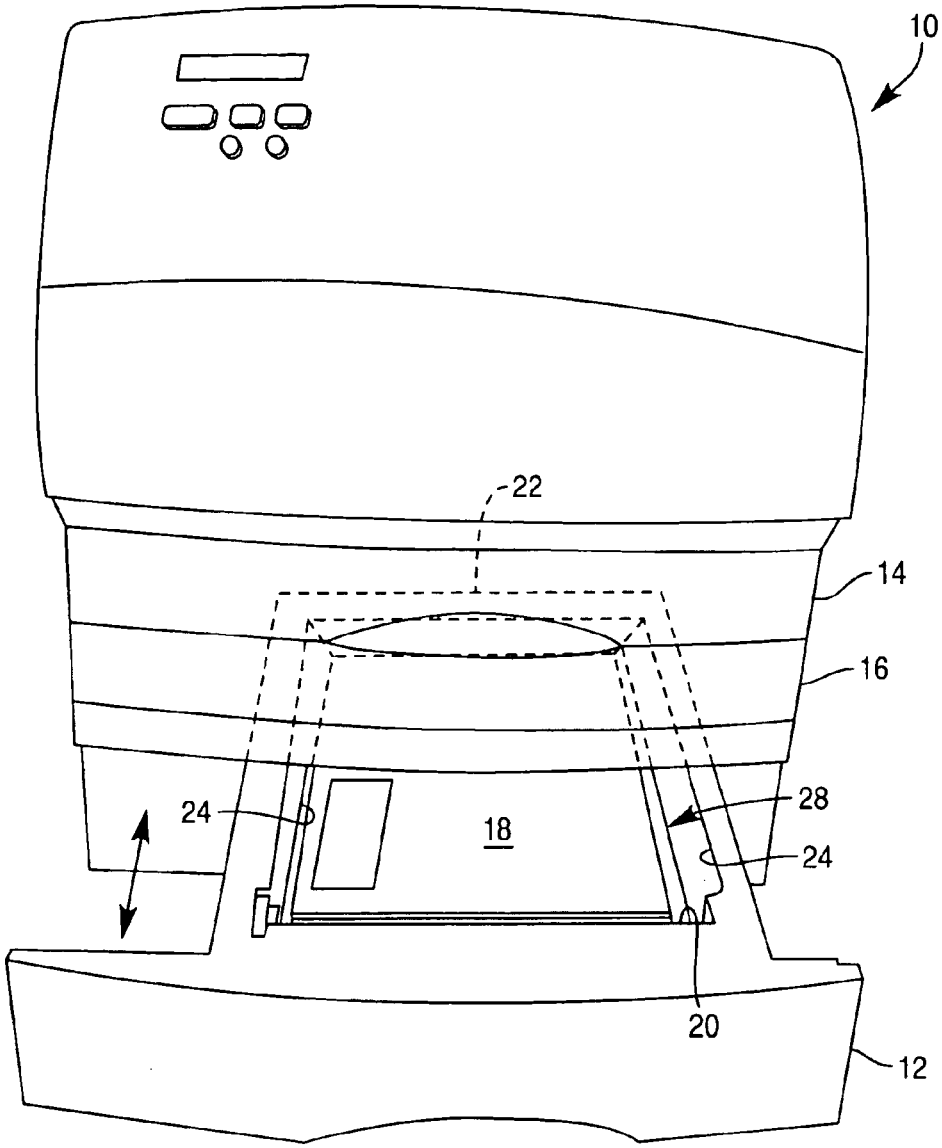
FIG. 1 is a front elevational view of exemplary laser printer with a partially open lower paper tray including a tray riser in accordance with one embodiment of the present invention hidden below a stack of sheets held in the tray.

Illustrated in FIG. 1 is an exemplary laser printer 10 including a lower feed drawer or tray 12, shown partly open, an upper drawer or tray 14, shown closed, and a duplexer module 16 mounted vertically therebetween. The basic printer is conventional and feeds sheets 18 of any suitable composition and configuration from either tray for transport through the printer for printing any desired print on one or both sides thereof.

The sheets 18 are stored in a stack in the lower tray 12 and are in the exemplary form of two-ply laminated form sheets. Each form includes a base sheet laminated to a release liner by pressure sensitive adhesive and a release agent such as silicone. The base sheet has a standard rectangular configuration and size, such as 8½ by 14 inches, and the liner is slightly less than 8½ inches wide and about 5 inches long, or shorter, for covering only the leading edge portion of the form.

The base sheet is die cut to form variously sized removable labels which may be peeled away from the underlying release liner. The base sheet is typically bond paper, and the release liner is typically supercalendared kraft (SCK) paper, although bond paper may also be used, coated with silicone on one side for permitting easy removal of the pressure sensitive adhesive labels when desired.

The printer 10 illustrated in FIG. 1 is conventional, such as a Lexmark T520 laser printer with or without the duplexer, and is commercially available from Lexmark International Inc., Lexington, Ky. The lower tray 12 is typically sized and configured for holding a ream of 500 sheets of paper. The upper tray 14 may be sized and configured for holding a full ream or half ream of paper depending on the particular model in the T or S series of Lexmark printers.

Figure 2:
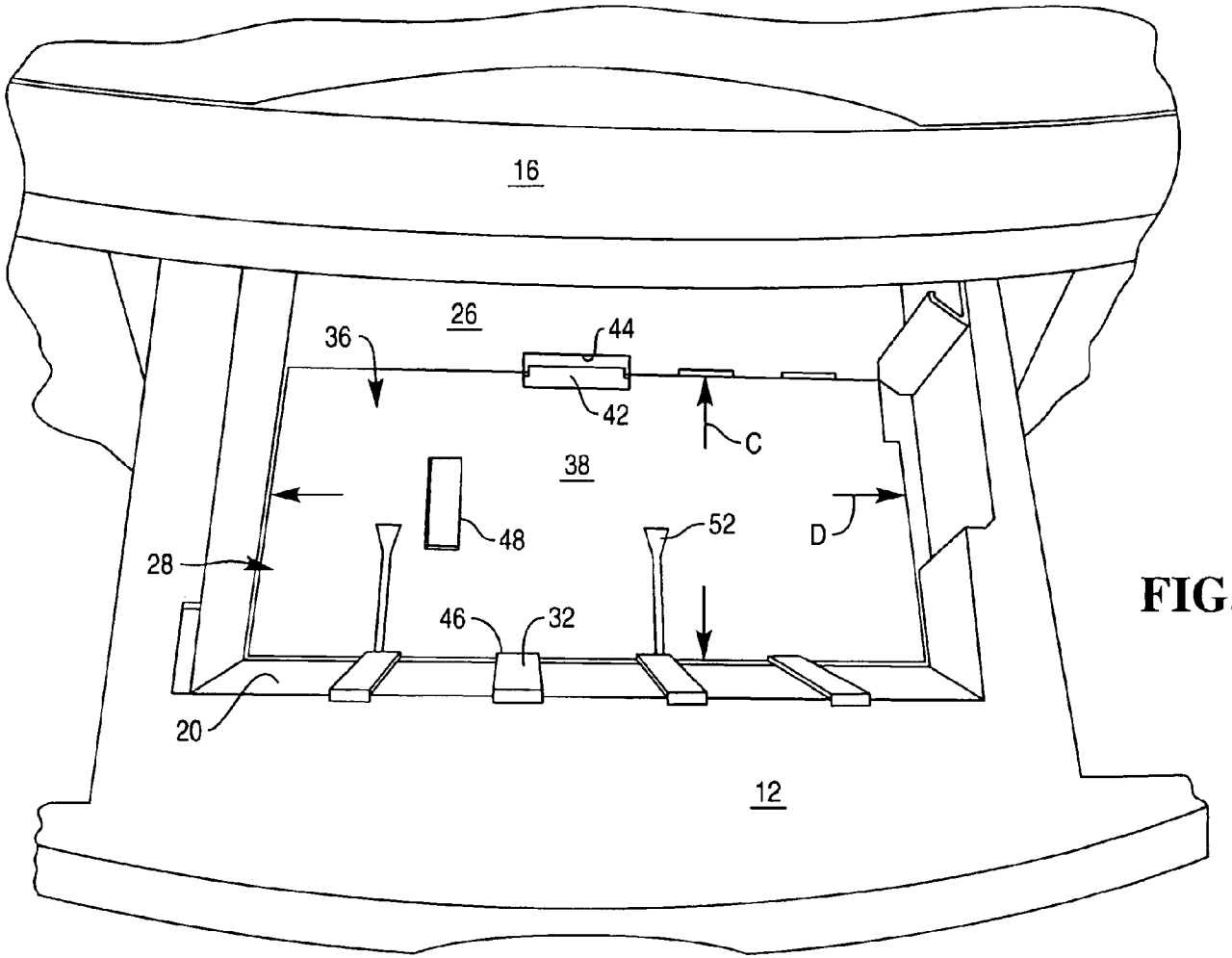
FIG. 2 is a front view of the paper tray of FIG. 1 shown without the sheets therein.

The lower tray 12, illustrated filled in FIG. 1 and empty in FIG. 2, is primarily made of plastic with selective use of metal components therein, and includes front and back walls 20,22, two opposite sidewalls 24, and a closed bottom or floor 26 all joined together in a rectangular configuration defining a well 28 for holding the stack of the form sheets 18.

The laminated form sheets 18 are illustrated in FIG. 1 in the exemplary form of pharmacy scripts for recording commercial pharmaceutical transactions. The pharmaceutical forms 18 may be fed in a single pass through the printer for printing one or both sides of the form, including the laminated labels in the two-ply section as well as the single ply portion of the form. The pharmacist may then remove one or more of the individual labels and apply them to the pharmaceutical container, with the remaining single ply portion of the form sheet containing written instructions for the customer and a record of the pharmaceutical transaction.

Since the forms are intended for use by various pharmacies having various printers, it is desirable that the same two-ply pharmaceutical form be readily usable in any commercially available laser printer. However, it has been discovered that corner curling of the forms being fed from the paper tray may occur in the above described series of Lexmark printers, but in other types of laser printers this type of corner curling has not been a problem. Furthermore, it has also been discovered that corner curling of the forms appears to be a problem solely in the lower tray 12 illustrated in FIG. 1 but not in the upper tray 14, which may be due to the different sizes or configurations thereof and feedpaths therefrom.

Corner curling of the form sheets being fed from the feed trays is undesirable since the corners can be bent over backwards in a typical dog-ear fashion during transport through the printer, which damages the form and may cause skewing and jamming of the sheet inside the printer.

Figure 3:
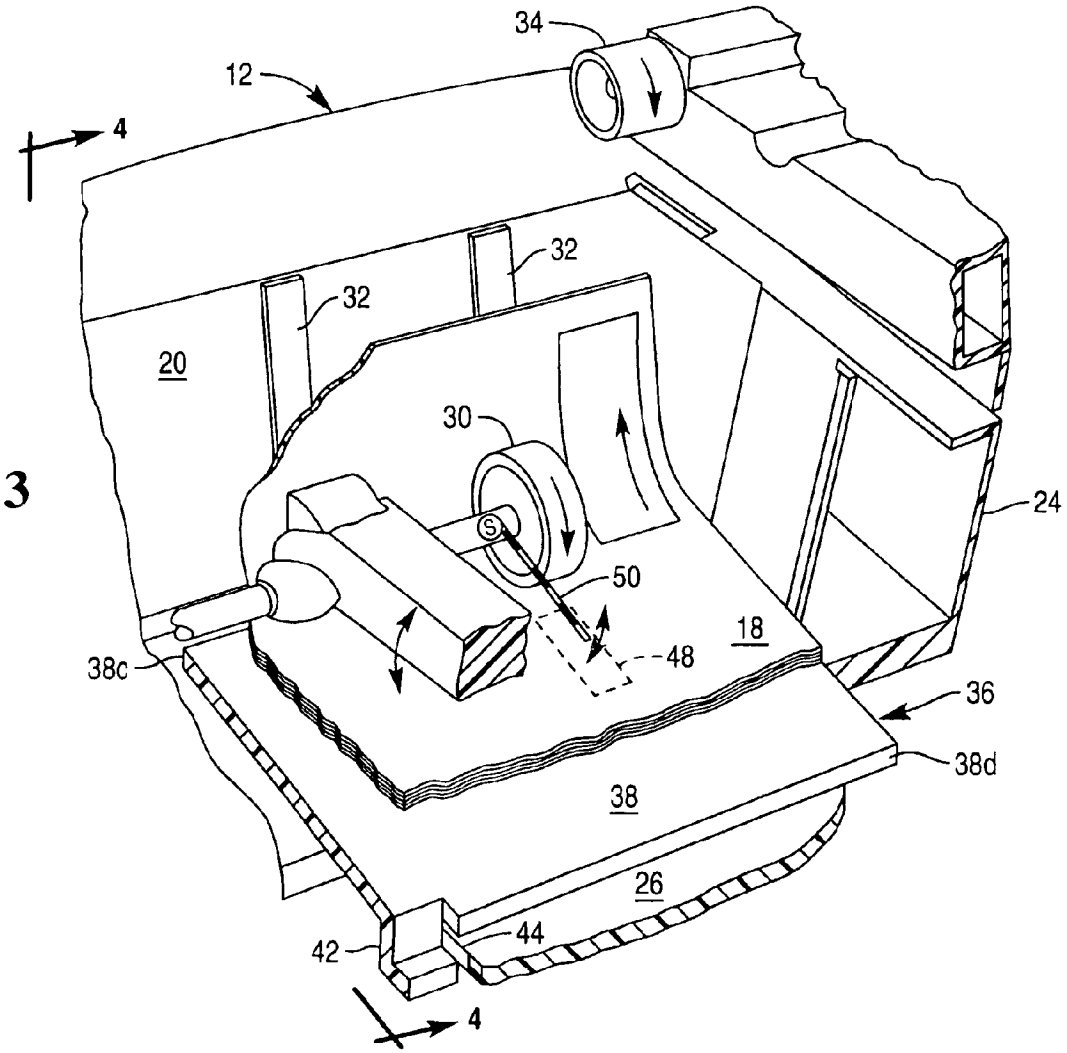
FIG. 3 is an enlarged isometric view of a front corner of the paper tray shown in FIG. 2 illustrating the installed tray riser in greater detail.

FIG. 3 illustrates in isolation the forward left corner of the lower feed tray 12 defined by the intersection of the front wall 20 and left sidewall 24 in the exemplary Lexmark printer. The lower tray is shown installed in the printer, and the surrounding portions of the printer are removed for clarity of presentation. The printer includes a pair of pickup rollers 30, one of which is shown, which are suitably supported inside the printer from a cantilevered boom which hangs in position atop the stack of forms when the tray is closed. The pickup rollers are driven to frictionally engage the top sheet of the stack and drive that sheet forwardly and upwardly along the inclined inner surface of the front wall 20 of the tray.

The front wall 20 includes in this exemplary printer a plurality of laterally spaced apart ridges or ribs 32 extending upwardly. The ridges are flat and formed of metal for reducing wear as the sheets are driven therealong during feeding.

As the leading edge of the top sheet leaves the lower tray along the ridges 32 it is met by a conventional drive roller 34 which frictionally engages the side of the form to continue transporting the form through the printer, which further includes a series of drive rollers for completing the transport path to the output tray of the printer.

The drive wheel 34 illustrated in FIG. 3 is directly in line with the forward corner of the form being fed into the printer, and any curling of that forward corner can lead to the undesirable dog-ear bend as the drive roller frictionally engages the curled corner. This problem appears to be caused in this printer by the reduction in stack height as forms are removed from the tray. The problem appears as the pickup rollers drive the sheet up the inclined front wall 20 over an extended distance before reaching the drive roller 34 suitably mounted in the printer above the lower tray.

In accordance with the present invention, a simple tray riser 36 and method for its use are provided for reducing curling of the leading edge of the form being withdrawn from the lower feed tray 12 in the Lexmark printer. A particular advantage of the method is that no changes by the original manufacturer of the printer are required in the printer, nor are any changes required in the type of sheet itself. Instead, a discrete tray riser 36 initially illustrated in FIGS. 2 and 3 is installed or retrofitted into the lower tray 12 using pre-existing features thereof.

Figure 4:
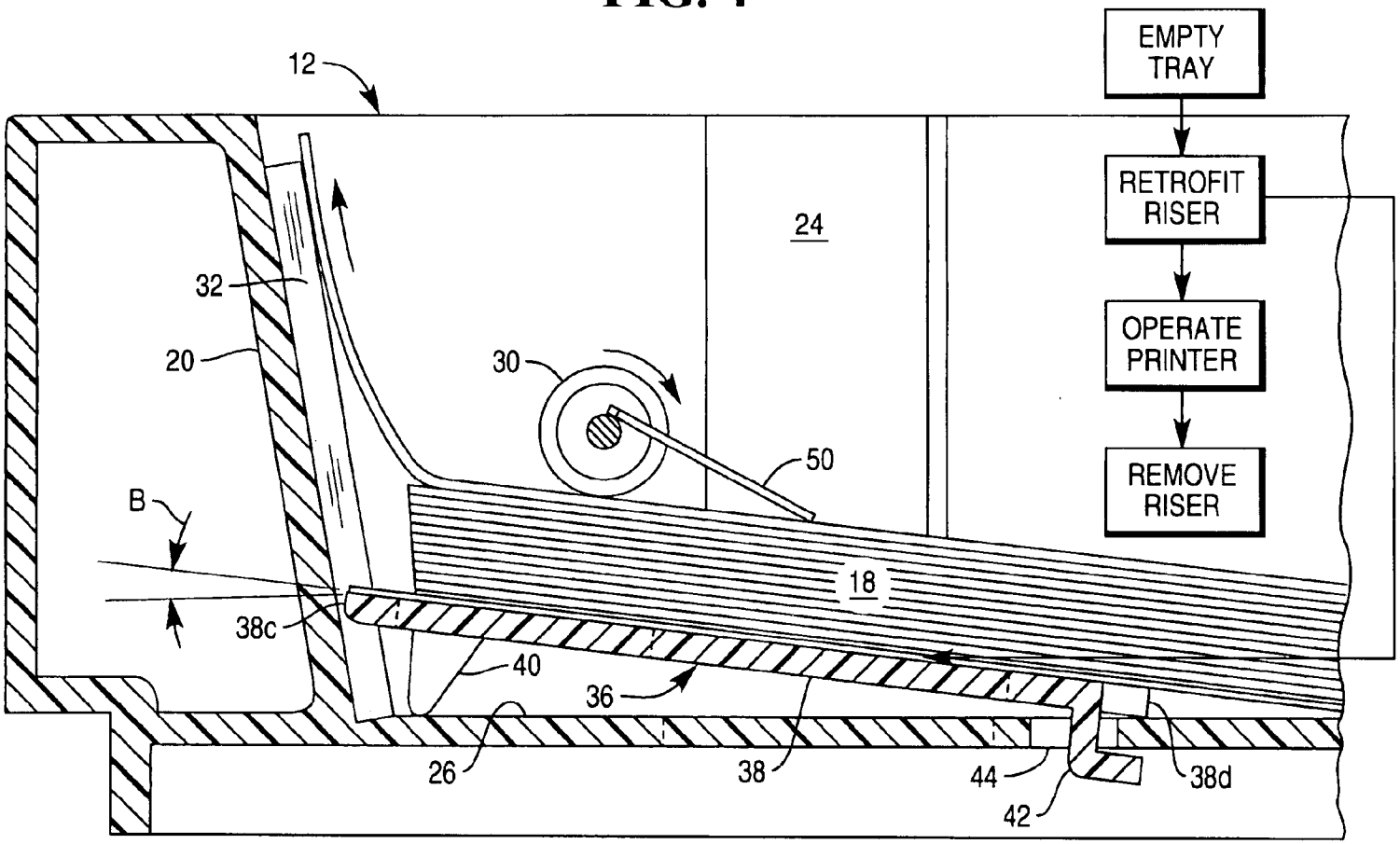
FIG. 4 is a partly sectional, side elevational view of the paper tray illustrated in FIG. 3 showing the tray riser supporting the front ends of the sheets.
Figure 5:
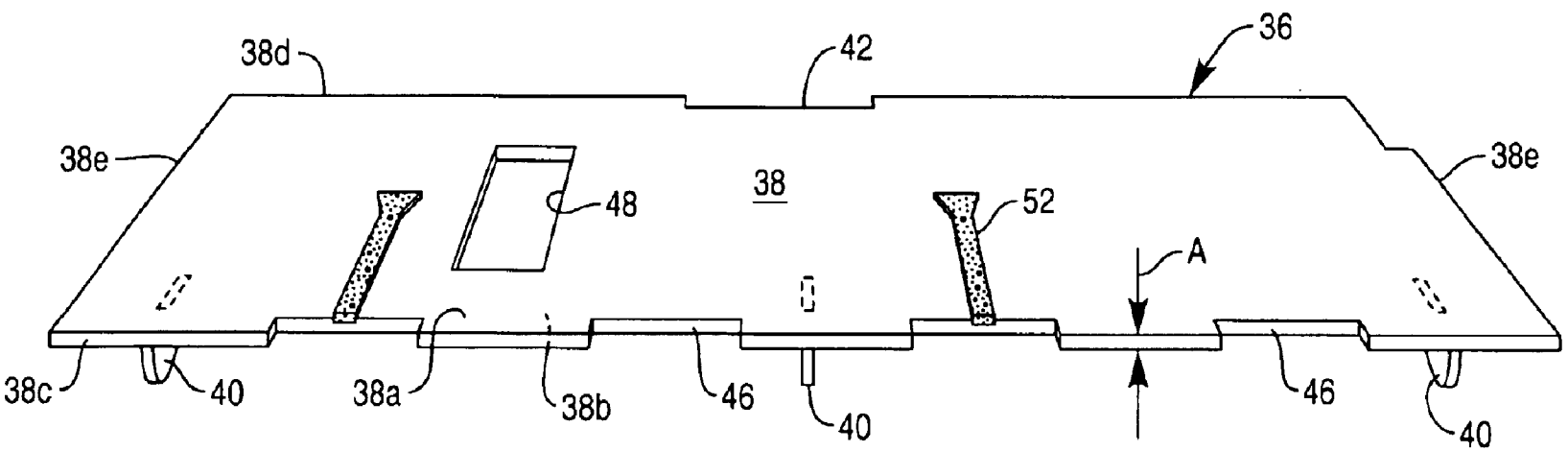
FIG. 5 is a front perspective view of the tray riser in accordance with a preferred embodiment.

The tray riser 36 is illustrated in section view installed in the lower tray in FIG. 4, and in isolation in FIG. 5. The riser is in the preferred form of a thin plate 38 which may be conveniently formed of a suitable, molded plastic. As initially shown in FIG. 5, the plate includes a flat top surface 38*a*, an opposite bottom surface 38*b*, front and back edges 38*c,d*, and laterally opposite side edges 38*e*. The flat top surface of the riser 36 is illustrated in FIG. 4 supports the stack of sheets 18 thereon during use.

A support stand 40 is integrally formed with the plate bottom surface 38*b* to position the front edge 38*c* higher in elevation than the back edge 38*d*. A retention clip or tab 42 is also integrally formed with the plate for engaging a pre-existing feature 44 in the tray to retain the riser in that tray during operation. A particular advantage of the tray riser illustrated in FIG. 5 is its simplicity of configuration, with the thin plate 38 having a uniform thickness A, and integrally formed with the support stand 40 and the retention tab 42 in a unitary or one-piece construction which may be inexpensively manufactured using molded plastic. In the preferred embodiment illustrated, the support stand 40 is in the form of a plurality of integral feet or lugs laterally spaced apart from each other along the plate front edge 38*c* below the bottom surface thereof.

The retention tab 42 is preferably in the form of a L-shaped hook projecting downwardly and rearwardly from the bottom surface of the plate adjacent the middle of the plate back edge 38*d*. The tab hook is conveniently configured in this manner for engaging the pre-existing aperture 44 which defines the retention feature in the original tray as illustrated in FIGS. 2–4. The retention aperture 44 is a plain rectangular hole existing in the lower tray 12, and the retention tab 42 is specifically configured for being inserted into that hole for securely retaining the tray riser in the front of tray without permitting rearward movement thereof.

Since the lower tray illustrated in FIGS. 2 and 4 includes the front ridges 32 against which the sheets are driven during operation, the front edge 38*c* of the plate is configured to complement those ridges by including a plurality of rectangular notches 46 specifically sized for receiving the corresponding ridges 32 which have corresponding rectangular cross sections. In this way, the riser extends forwardly to the front wall 20 of the tray completely under the leading edge portions of the sheets, and is conveniently trapped both forwardly and laterally by the tray front wall and ridges which engage the complementary plate front edge and notches. The tray riser is thusly trapped at the front of the tray against movement both laterally and front-to-back in the tray.

As best illustrated in FIG. 4, the stand-off lugs 40 at the front of the tray riser are preferably sized in height to incline the plate top surface upwardly from the back edge 38*d* to the front edge 38*c* at a shallow acute angle B. The inclination angle B is relative to the horizontal plane or floor of the tray and is suitably shallow, for example up to about 15 degrees, for slightly raising the front of the sheets relative to the back of the sheets. But for the tray riser illustrated in FIG. 4, the sheet stack would lay horizontally flat within the tray without inclination.

The amount of riser incline may be selected for the particular configuration of the tray being retrofitted, based on the height of the well in which the sheets are stacked and the vertical orientation or inclination of the tray front wall 20, which is inclined slightly forwardly in the exemplary embodiment illustrated in FIG. 4. For the exemplary Lexmark printer of interest, an inclination of about 8 degrees for the tray riser is sufficient for guiding the leading edges of the sheets upwardly along the tray front wall and its ridges for engaging the drive roller 34 with little if any curl for reducing the likelihood of the curling problem.

Of course the various forms of commercially available printers are well designed and tested for ensuring unobstructed travel of the sheet being fed through the printer during operation. However, the size, type, configuration, and material composition of the various sheets which may be stored in a printer tray vary considerably for the specific uses intended therefor. The full ream capacity of the lower tray 12 illustrated in FIG. 4 correspondingly requires a sufficient vertical height of the well. As the number of sheets is depleted in the tray during use of the printer, the vertical distance between the remaining top sheet of the stack and the corresponding drive roller increases, increasing the possibility of undesirable curling of the sheet leading edge which may lead to clipping thereof, or skewing or jamming inside the printer.

Recognizing the proper performance of conventional printers for various types of sheets being fed, the introduction of the simple tray riser for temporary use in no way affects the intended performance or capabilities of the printer itself. The tray riser is a simple device which may be readily installed when desired and conveniently removed when desired for resolving the temporary occurrence of undesirable curling when required. At all other times, the conventional paper tray can be operated without the tray riser for maintaining the intended normal operation thereof.

In the exemplary embodiment illustrated in FIGS. 2 and 5, the riser plate 38 is rectangular, being shorter in length C between the front and back edges 38*c,d* than in width D between the lateral edges 38*e*.

As shown in FIG. 2, the plate 38 is preferably sized in width D to laterally bridge the lower tray 12 completely under the stack of sheets disposed therein as shown in FIG. 1. And, the plate is preferably sized in length C as shown in FIG. 2 to be shorter than the half-length of the tray, or its internal well, and is preferably about one third the length of the tray well which receives the stack of sheets.

The tray riser may have various forms, preferably all of which should be sufficiently wide to fully support the full width of the sheets being stored in the tray. The length of the tray riser need only be sufficient for raising the leading edge portions of the sheets as illustrated in FIG. 4 for promoting free travel of the sheets in engagement with the first drive roller for preventing the problems addressed above. If desired, the length of the tray riser may be increased to reach the back wall of the tray itself, and the tray may vary in its otherwise rectangular configuration, including generally L-shaped configurations, for filling or partly filling the available floor space within the specific configuration of the tray. Since the typical paper tray includes adjustment for the width of the sheets being stored therein, the tray riser should be configured to avoid interference with such width-adjusting features.

Since the tray riser should be configured for permitting all normal operation of the specific configuration of the tray and cooperating printer, the specific form of tray riser illustrated in FIGS. 3–5 includes a generally rectangular access aperture 48 extending between the top and bottom surfaces thereof and extending longitudinally between the front and back edges 38*c,d* for receiving a pre-existing switch arm 50 of the printer. The switch arm 50 includes a cantilevered arm and a cooperating switch suspended from the frame of the pickup rollers 30 which is used for indicating out-of-paper condition.

The access aperture 48 is conveniently located in the tray riser itself in alignment with the conventional switch arm 50. In this way, when the last sheet is fed from atop the tray riser in the tray, the switch arm 50 may move downwardly into the aperture for activating the switch and providing an indication that the tray is empty of the sheets therein.

As shown in FIGS. 2 and 5, the tray riser may also include a plurality of elongate friction pads 52 suitably affixed or embedded into corresponding recesses in the plate top surface for cooperating with the pre-existing pickup rollers 30 shown in FIG. 3. The friction pads 52 themselves may be conventional, such as being formed of foam rubber or cork, and are mounted in the tray riser in substantially the same position as conventional friction pads in the floor of the lower tray itself. In this way, when only a few sheets remain in the tray atop the tray riser, the friction pads are useful for restraining multiple feeding of the remaining sheets as the sheets thereatop are fed in turn.

FIG. 4 illustrates in flowchart form an exemplary method of using the tray riser 36 in the cooperating laser printer. Initially, the lower tray 12 is emptied of any sheets 18 therein for providing access to the floor thereof. The tray riser 36 is then simply placed inside the tray with its top surface 38*a* facing upwardly, the back edge 38*d* facing rearwardly, and the front edge 38*c* facing forwardly. The tab hook 42 at the back edge of the tray riser is inserted into the retention aperture 44 for engagement therewith, and the stand-off lugs 40 at the front edge of the tray riser are simply rested directly atop the floor of the tray. The tray riser is thusly simply trapped inside the tray in a stationary configuration without lateral or vertical movement.

A stack of sheets 18 is then placed atop the tray riser within the tray well in a typical manner. The tray is inserted into the printer, and the printer is operated in a conventional manner for feeding the stacked sheets individually from atop the tray riser. Since the tray riser elevates the front portion of the sheets as illustrated in FIG. 4, the suspended pickup rollers 30 drive the individual sheets at a greater included angle with the tray front wall 20 and the guiding ridges 32 for reducing the likelihood of undesirable curl of the sheets.

The tray riser may be used for as few sheets or as many sheets as desired in the printer, and when no longer required, the tray riser may be removed from the tray by firstly removing any remaining sheets thereatop and then simply lifting the riser itself upwardly from the tray to disengage the tab hook 42 from the retention aperture 44. Such simple lifting and removal of the tray riser requires no tools, and no disconnection of any other connections between the riser and the tray.

In its simplest form, the tray riser is merely a rectangular plate having a suitable stand integrally formed therewith for elevating the front edge thereof relative to its back edge. And, the shelf riser may be suitably configured for being self-retained in the front of the lower tray by simple gravity, and interference with adjacent portions of the surrounding tray well.

In thin plate form, the tray riser may be economically manufactured using conventional plastic molding processes for integrally forming all of the required features thereof, with the friction pads being separately manufactured and affixed thereto, if desired.

Of particular importance is the relative simplicity of the tray riser specifically configured to occupy space in the tray normally reserved for the sheets themselves, with the tray riser being configured to avoid any interference with the pre-existing features of the tray and the normal operation thereof.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A retrofit tray riser for use in a paper tray having front and back walls defining a well to hold a stack of sheets for being fed by leading edge over said front wall into a printer, comprising:

a plate having a top surface for supporting said stack of sheets in said tray, and opposite front and back edges between which said sheets are dispensed from said tray;

a stand integrally formed with a bottom surface of said plate to position said front edge adjacent said tray front wall and higher in elevation than said back edge; and a retention tab integrally formed with said plate for engaging a pre-existing feature in said tray to retain said riser in said tray.

2. A tray riser according to claim 1 wherein said plate has a uniform thickness, and said stand includes a plurality of lugs laterally spaced apart along said plate front edge.

3. A tray riser according to claim 2 wherein retention tab is disposed adjacent said plate back edge.

4. A tray riser according to claim 3 wherein retention tab forms a hook projecting downwardly from said plate adjacent the middle of said plate back edge for engaging a pre-existing aperture defining said retention feature.

5. A tray riser according to claim 4 wherein said plate front edge includes a plurality of notches sized for receiving pre-existing ridges extending upwardly in the front of said tray.

6. A tray riser according to claim 4 wherein said plate further comprises an access aperture disposed between said front and back edges for receiving a pre-existing switch arm of said printer.

7. A tray riser according to claim 4 further comprising a plurality of friction pads affixed to said plate top surface for cooperating with pre-existing pickup rollers in said printer.

8. A tray riser according to claim 4 further comprising:

a plurality of notches laterally spaced apart along said plate front edge and sized for receiving pre-existing ridges extending upwardly in the front of said tray;

an access aperture disposed in said plate between said front and back edges for receiving a pre-existing switch arm of said printer; and a plurality of friction pads embedded in said plate top surface on laterally opposite sides of said access aperture for cooperating with pre-existing pickup rollers in said printer.

9. A tray riser according to claim 4 wherein said lugs are sized in height to incline said plate top surface upwardly from said back edge to said front edge at a shallow acute angle.

10. A tray riser according to claim 4 wherein said plate is rectangular, being shorter in length between said front and back edges than in width between lateral edges thereof.

11. A tray riser according to claim 10 wherein said plate is sized in width to laterally bridge said tray completely under said stack of sheets therein.

12. A tray riser according to claim 11 wherein plate is sized in length shorter than half-length of said tray.

13. A method of using said tray riser according to claim 4 comprising:

emptying said paper tray of any sheets therein;

placing said tray riser inside said tray with said top surface facing upwardly, said back edge facing rearwardly, and said front edge facing forwardly;

engaging said tab hook into said retention aperture in said tray;

resting said stand lugs atop said tray;

placing a stack of sheets in said tray atop said tray riser therein; and operating said printer with said tray inserted therein to feed said sheets individually from atop said tray riser.

14. A method according to claim 13 further comprising:

removing said tray riser from said tray by simply lifting said riser upwardly therefrom to disengage said tab hook from said retention aperture;

placing a stack of sheets in said tray; and operating said printer without said tray riser to feed said sheets individually from said tray.

15. A retrofit tray riser for use in a paper tray having front and back walls defining a well to hold a stack of sheets for being fed by leading edge over said front wall into a printer, comprising:

a plate having a top surface for supporting said stack of sheets in said tray, and opposite front and back edges between which said sheets are dispensed from said tray;

a plurality of stand-off lugs laterally spaced apart along said plate front edge and integrally formed with a bottom surface of said plate in a unitary construction to position said front edge adjacent said tray front wall and higher in elevation than said back edge; and a retention hook projecting downwardly from said plate adjacent the middle of said plate back edge for engaging a pre-existing aperture in said tray to retain said riser in said tray.

16. A tray riser according to claim 15 further comprising:

a plurality of notches laterally spaced apart along said plate front edge and sized for receiving pre-existing ridges extending upwardly in the front of said tray;

an access aperture disposed in said plate between said front and back edges for receiving a pre-existing switch arm of said printer; and a plurality of friction pads embedded in said plate top surface on laterally opposite sides of said access aperture for cooperating with pre-existing pickup rollers in said printer.

17. A tray riser according to claim 16 wherein said lugs are sized in height to incline said plate top surface upwardly from said back edge to said front edge at a shallow acute angle up to about 15 degrees.

18. A tray riser according to claim 17 wherein said plate has a uniform thickness, and is sized in width to laterally bridge said tray completely under said stack of sheets therein.

19. A tray riser according to claim 18 wherein said plate is rectangular, being shorter in length between said front and back edges than in width between lateral edges thereof.

20. A paper tray for a printer, comprising:

a rectangular well having a floor for supporting a stack of sheets, an aperture in said well floor, and a front wall having a plurality of vertical ridges; and a tray riser including:

a plate having a top surface for supporting said stack of sheets in said tray, and opposite front and back edges between which said sheets are dispensed from said tray;

a plurality of stand-off lugs laterally spaced apart along said plate front edge and integrally formed with a bottom surface of said plate to position said front edge higher in elevation than said back edge; and a retention hook projecting downwardly from said plate adjacent the middle of said plate back edge for engaging said tray aperture to retain said riser in said tray.

* * * * *